United States Patent [19]

Brickman

[11] 4,177,737

[45] Dec. 11, 1979

[54] FOLDABLE CONVERTIBLE STOOL-TABLE-BAR

[76] Inventor: Harold Brickman, 2911 W. Catalpa, Chicago, Ill. 60625

[21] Appl. No.: 815,717

[22] Filed: Jul. 14, 1977

[51] Int. Cl.[2] ..... A47B 85/00

[52] U.S. Cl. ..... 108/11; 108/25; 108/118

[58] Field of Search ..... 108/11, 14, 25, 118, 108/119; 312/235; 297/188, 189, 192, 193, 2, 7; 248/150, 146

[56] References Cited

U.S. PATENT DOCUMENTS

| | | | |
|---|---|---|---|
| 1,426,160 | 8/1922 | Driver | 108/118 X |
| 1,833,178 | 11/1931 | Rice | 108/25 X |
| 1,835,661 | 12/1931 | Marquardt | 108/118 X |
| 2,333,734 | 11/1943 | Nieltopp | 297/188 |
| 2,982,455 | 5/1961 | Rosen | 297/192 X |
| 3,034,153 | 5/1962 | Sargent | 108/118 X |
| 3,122,397 | 2/1964 | Mintz | 297/192 |
| 3,763,972 | 10/1973 | Karzmar | 297/188 |

FOREIGN PATENT DOCUMENTS

| | | | |
|---|---|---|---|
| 215984 | 5/1924 | United Kingdom | 108/11 |

*Primary Examiner*—Roy D. Frazier
*Assistant Examiner*—Peter A. Aschenbrenner
*Attorney, Agent, or Firm*—McDougall, Hersh & Scott

[57] ABSTRACT

A collapsible camp chair which is convertible into a table adapted to retain various types of contents in a stable position.

6 Claims, 5 Drawing Figures

FOLDABLE CONVERTIBLE STOOL-TABLE-BAR

This invention relates to a camp stool which is convertible for use as a table and in which both the camp stool and table embody means for holding containers such as cups, glasses, bottles and other utensils, in a manner to provide easy access while being retained under normally unsteady conditions.

The invention has primarily to do with a piece of furniture adapted for shipboard use, where the ship or boat is subject to being continuously tossed about to provide, what may be referred to, as a condition too unstable to enable a glass or cup to be placed on a flat surface. While the invention will be described with reference to shipboard conditions and use, it will be understood that the invention will have application to other environments characterized by an unsteady surface.

Various devices and techniques have been adopted for retention of a drinking glass or cup under unsteady conditions. These usually involve a holder of some sort as an attachment to the chair or other part of the vessel, or an extension from the chair, table, or other portions of the boat's or ship's structure. This of course restricts the utility of the holder. It not only presents an undesirable obstruction, but such attachments or extensions usually interfere with the ability to pack the chair or table to form a compact structure for storage. In addition, the above factors, such as attachments or extensions, add materially to the cost of the equipment and their exposure makes them subject to breakage or to injury of others.

It is an object of this invention to provide a piece of furniture that can be used on a boat or other unsteady surface either as a chair or table and which embodies means in the form of pockets in which a cup, glass, bottle or utensil can be inserted in order to be held in a stable condition without interference with access thereto, and in which the means adds little cost to the unit and does not interfere with the flexibility of use or folding into a compact package for storage.

These and other objectives and advantages of this invention will hereinafter appear, and for purposes of illustration, but not of limitation, embodiments of this invention are shown in the accompanying drawings in which.

Figure 1:
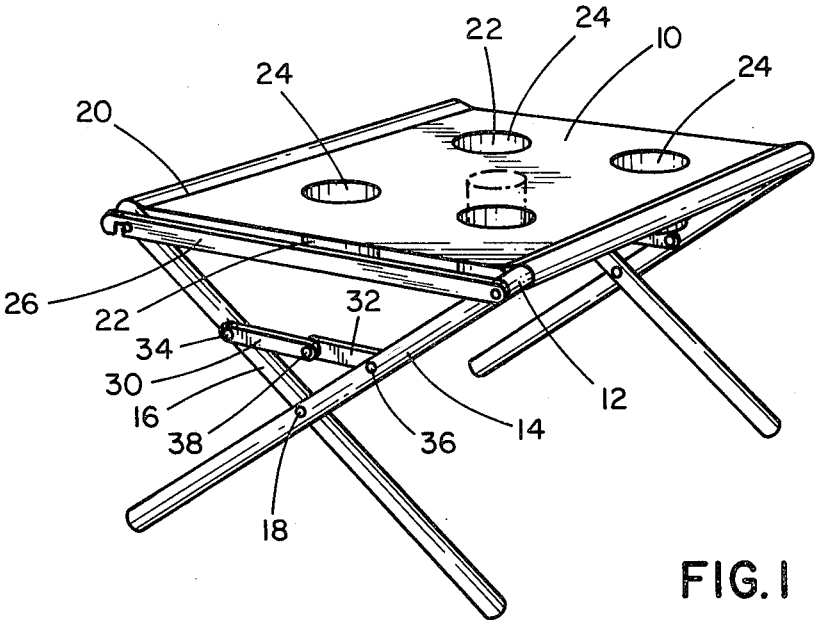
FIG. 1 is a perspective view of the convertible unit embodying the features of this invention, with the unit shown in open position.

The convertible unit of this invention is in the form of a camp chair constructed with a flexible fabric 10 which is secured along its lateral edges to cross brace rods 12 which extend crosswise between the upper ends of laterally spaced apart pairs of criss crossing elongated frame members 14 and 16 pivoted one to the other intermediate their ends on interconnecting pivoted pins 18.

The fabric 10 is dimensioned to have a length which is less than the sum of the distance between the cross brace members 12 and the pivot 18 and preferably one-half to about three-quarters of the total length so that the fabric will limit the extent to which the legs 14 and 16 of the frame members can be unfolded to open position. Any downward pressure applied to the fabric, such as a person sitting thereon, will be transmitted to the frame members constantly to urge the frame members towards unfolded position thereby to maintain tension on the fabric in the lenghtwise direction.

The frame legs and the connecting cross brace member 14 can be formed of a single length tubular member formed of a single tubular member of metal or plastic bent to the desired shape, or it can be formed of separate elongated metal or wooden members interconnected at their upper ends but without elongated metal, wooden or plastic cross brace member with the ends interconnected or joined by well known fastening means, such as clips, metal welding, nut and bolt means, nails, screws or the like.

The flexible fabric 10 can be a fabric woven of suitable fibers such as cotton, sisal, hemp, and the like natural fibers, or of dacron, rayon, nylon, polyester or the like synthetic resins, or it can be formed of leather or synthetic leather like materials, plastic sheets and the like flexible sheet material. Attachment along its lateral edges to the cross brace members can be effected by providing a continuous hem 20 through which the cross brace members 12 extend, such hem being formed by stitching, heat welding or other means for joining the ends of the fabric to an interior portion to form the loop or hem.

The described unit can be unfolded to form a stool or folded for storage as a compact package.

An important feature of this invention resides in the construction wherein the flexible fabric 10 is formed with one or more pockets 22 defined by openings 24 in the fabric 10 of various shapes, in which the openings are preferably formed to correspond in shape and dimension to the cross section of a glass, bottle, cup, or other container to enable insertion for receipt within the pocket in seated relation. The pockets 22 are dimensioned to have a depth less than the depth of the container adapted to be received therein, so that the lower portion of the container will rest in the pocket while the upper portion will extend above the fabric 10 for easy access. Thus the fabric 10 stretched between the cross brace members 12 can serve as a table top with means embodying as an integral part thereof for holding glasses, bottles, dishes, cups and the like against undesirable movement notwithstanding the instability of the surface on which the table rests.

The pockets 22, preferably located at the corners of the fabric for holding glasses, cups or bottles, or located midway between the edges for holding saucers or plates, can be molded into the fabric for deep drawing, blow molding or the like molding operations when the fabric is formed of a thermoplastic material. Instead, the pockets 22 can be formed of a textile material or other fabric material and joined to the portion 10 in registry with the opening 24. Such jointer can be effected by providing an angular flange at the open end of the pocket which overlaps the edge portion about the openings for attachment thereto as by stitching or adhesive.

Though not essential, it is desirable to provide means for bracing the cross piece members in open position so that the fabric table top 10 will be maintained in a relatively taut position. For this purpose, side arms 26 dimensioned to have a length corresponding to the length of the fabric, are provided at each side with the side arms pivoted at one end on one cross brace member, with latching means provided in the lengthwise aligned portion of the other cross brace member in position to be engaged by the free end of the side arm 26 to retain the side arm in its tension position. Such latching means can simply be in the form of a groove 28 extending downwardly, from the top surface of the cross brace member, or an opening in the cross brace member of leg or adjacent portion of the leg through which the free end of the side arm can be inserted.

Instead of, or in addition to the side arm, the legs 14 and 16 can be braced in their open position by a pair of link members 30 and 32, one of which is pivoted at its outer end at 34 to a portion of one leg above its pivot 18, while the other is similarly pivoted at its outer end at 36 to the other leg with the inner end portions of the link members 30 and 32 interconnected one to the other by pivot pin 38. The linking members operate to limit unfolding of the legs to open position and to militate against collapse of the legs from open to folded position.

In use, the legs are merely unfolded to the extent limited by the link members or by the fabric 10 or both. The side arms 26 are rocked to raised position and latched at their free ends. Thus a table is provided that can be used with filled drinking glasses, bottles, dishes and the like containers supported by the table top without fear of spilling, breakage or the like during use.

Figure 3:
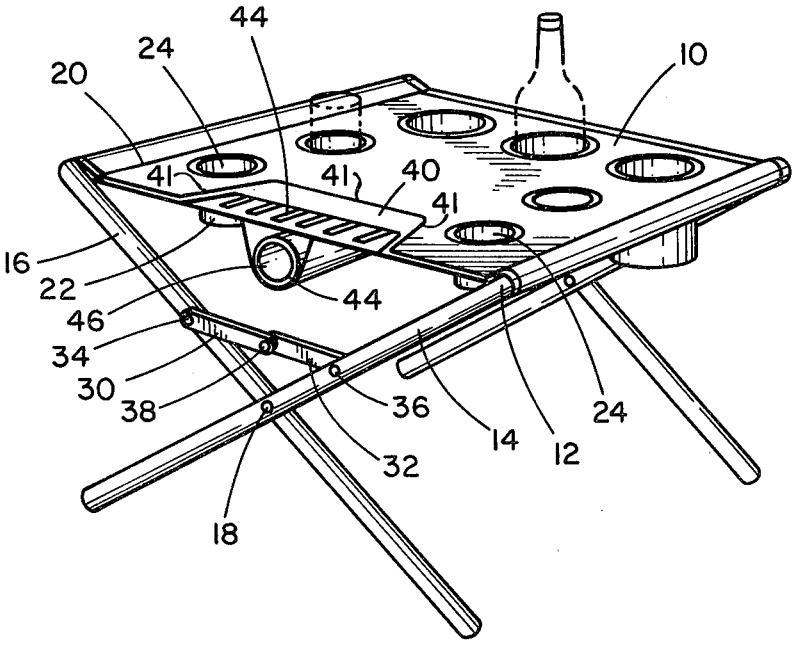
FIG. 3 is a perspective view of a modification of the unit embodying the features of this invention.
Figure 4:
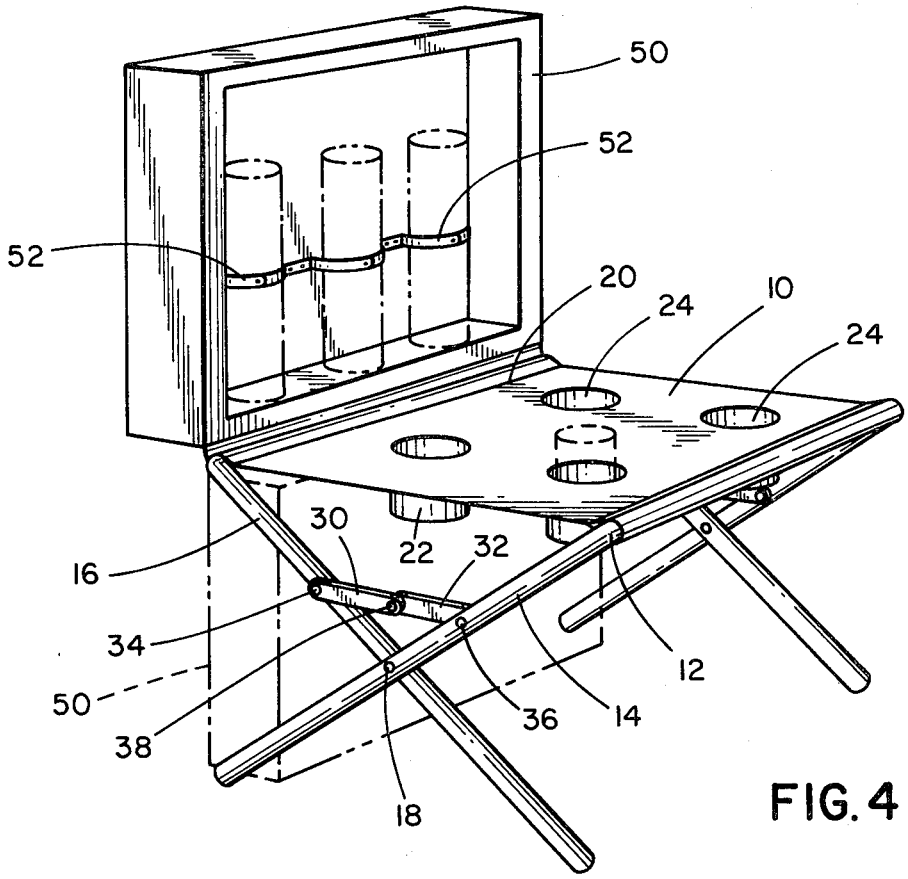
FIG. 4 is a perspective view showing a further modification which includes a seat and/or a compartment for the storage of bottles, glasses, utensils or the like equipment.
Figure 5:
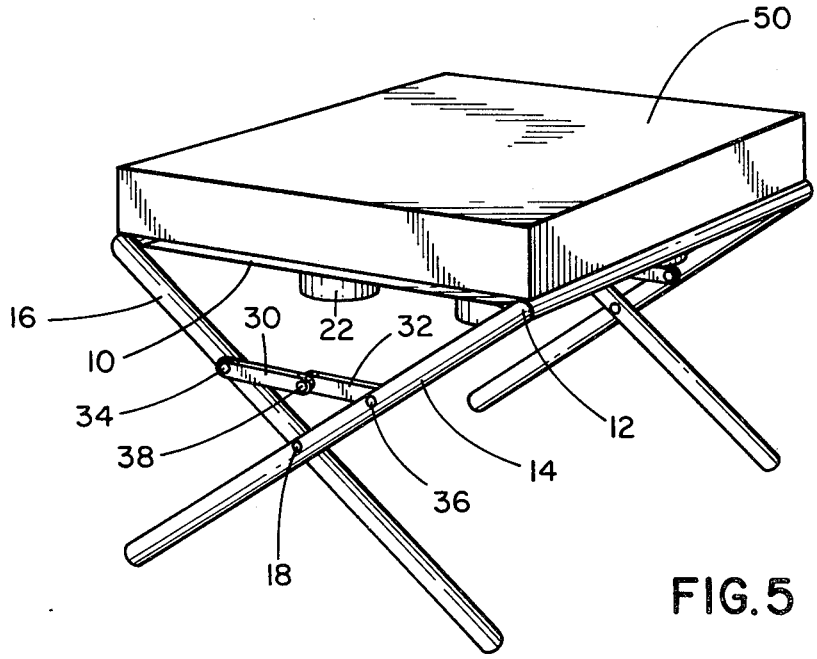
FIG. 5 is a perspective view of the modification shown in FIG. 4 with the seat in position of use.

As illustrated in FIG. 3, the fabric 10 can also be formed with horizontally disposed pockets 40 as by adding a strip secured at its edges 41 on the top side of the fabric 10 in which eating utensils, such as knives 42, forks, spoons and the like can be inserted for retention and for storage, with the pockets having a depth less than the length of the utensil so that a portion will remain exposed for access. Similar horizontally disposed pockets 44 can be provided on the underside of the fabric for retention of glasses 46, cups, bottles or other containers. The presence of such horizontally extending pockets with elements retained therein will not interfere with the foldability of the fabric to enable convertible use as a seat or table top.

The described convertible unit can be collapsed by release of the side arms 26 and folding links 30 and 32 to provide a compact packaging which takes up little space for storage and yet is always available for unfolding to form a stool or table.

A further concept of this invention comprises the modification wherein the unit described is provided with a hollow box like member 50 dimensioned to have a length and width corresponding to that of the flexible fabric with the box like member pivotally suspended from one of the cross brace members for rocking movement between operative and inoperative position. In the operative position, the box like member 50 extends across the top of the flexible fabric 10 and rests upon the cross brace members to provide a seat which can be cushioned on its upper surface. In the inoperative position, the hollow box like member is rocked about the pivot to depend downwardly from the cross brace member or supported to extend vertically therefrom. The hollow interior of the box like member is fitted with straps 52 to hold glasses, dishes, cups, bottles, utensils and the like thereby to serve as a storage space when used as a seat and to make the same freely available when used as a table.

Figure 2:
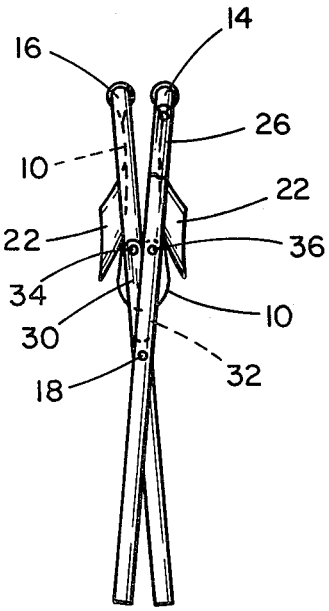
FIG. 2 is a side elevational view of the unit shown in FIG. 1 in folded position.

While the invention has been described with reference to a foldable unit which can be used interchangeably as a camp stool or a table, an important concept of this invention resides in the use of the foldable unit, shown in FIGS. 1, 2 and 3, as a service unit in the form of a tray having pockets of the type described which, when unfolded, present pockets in which glasses, bottles, ice buckets and the like can be inserted for transport to any desirable location where the tray can be set up on its own legs to serve as a portable bar.

Unlike trays, which have heretofore been used for bar purposes on ships or the like, the portable-folding bar of this invention provides its own stable support which militates against slippage. Unlike trays which have openings for the insertion of bottles or glasses therethrough, whereby such trays are restricted to use at locations having an underlying hollow space, such as a sink top, the portable bar of this invention is not faced with such restrictions in use since the tray top is suspended from its supporting legs and is open therebeneath.

Thus the folding bar-tray of this invention provides greater flexibility in use afforded from the fact that it can be easily folded into a compact package for storage and opened for receiving all of the elements of a complete bar, including glasses, bottles, dishes, ice buckets and the like, for placement wherever there is a relatively flat surface and which serves to retain the glasses, bottles and ice buckets in a stable upright position.

The openers, ice tongs and the like utensils can be stored in the pockets 44 whereby a complete bar with all of the fittings is provided in a foldable unit which is characterized by greater flexibility in use.

It will be understood that changes may be made in the details of the construction, arrangement and operation, without departing from the spirit of the invention, especially as described in the following claims.

I claim:

1. A foldable stool-table-bar comprising a pair of U-shaped members each of which is formed of a pair of laterally spaced apart legs joined at their upper edges by an elongated cross brace member, means pivotally mounting the leg of one member to the corresponding leg of the other intermediate their ends for rocking movement between open and collapsed position, a flexible fabric one edge of which is joined to one cross brace member while the other edge is joined to the other cross brace member to extend continuously between the cross brace members, openings in the fabric having a shape and dimension corresponding to cups, saucers, glasses, bottles or dishes, for enabling a base portion thereof to extend therethrough, and flexible pockets extending downwardly from said openings for a distance beyond the fabric but less than the length of the cups, saucers, glasses, bottles or dishes inserted therein.

2. A foldable unit as claimed in claim 1, which includes a pocket extending inwardly for a short distance from a lateral edge of the flexible fabric on the top side by means of a fabric secured to the top side of the flexible fabric with a portion spaced from the edge for enabling easy access into the pocket.

3. A foldable unit as claimed in claim 1, which includes a pocket extending inwardly for a short distance from the lateral edge of the flexible fabric on the bottom side of the flexible fabric by means of a fabric secured to the underside of the flexible fabric.

4. A foldable stool-table-bar comprising a pair of U-shaped members each of which is formed of a pair of laterally spaced apart legs joined at their upper edges by an elongated cross brace member, means pivotally mounting the leg of one member to the corresponding leg of the other intermediate their ends for rocking movement between open and collapsed position, a flexible fabric one edge of which is joined to one cross brace member while the other edge is joined to the other cross brace member to extend continuously between the cross brace members, and pockets extending downwardly from openings in the fabric shaped and dimensioned to correspond with contents adapted to be inserted therein, and which includes a hollow box like member dimensioned to correspond with the distance between the cross brace members in open position and means pivotally connecting an outer edge of a lengthwise wall of the open box like member to a cross brace member for pivotal movement thereabout between an operative position at rest on the cross brace members and an inoperative position to expose the fabric as a table top.

5. A foldable unit as claimed in claim 4, which includes cushioning material covering the top surface of the box like member.

6. A foldable unit as claimed in claim 4, which includes fittings in the interior of the hollow box like member for holding cups, glasses, dishes, bottles, openers, shakers and other eating and drinking equipment.

* * * * *